US005283979A

United States Patent [19]

Carlson et al.

[11] Patent Number: 5,283,979

[45] Date of Patent: Feb. 8, 1994

[54] LOCKING/OPENING SYSTEM FOR WATERTIGHT HATCH

[75] Inventors: Edward R. Carlson, New Fairfield, Conn.; Robert Elwell, Hyde Park, N.Y.

[73] Assignee: The Presray Corporation, Pawling, N.Y.

[21] Appl. No.: 980,619

[22] Filed: Nov. 23, 1992

[51] Int. Cl.[5] ..... E05C 9/00

[52] U.S. Cl. ..... 49/395; 49/383; 49/400; 49/465

[58] Field of Search ..... 49/395, 465, 383, 401, 49/400; 52/19, 20

[56] References Cited

U.S. PATENT DOCUMENTS

| | | | |
|---|---|---|---|
| 942,270 | 12/1909 | Legge | 49/395 X |
| 1,104,670 | 7/1914 | Horn . | |
| 1,416,308 | 5/1922 | Silverman et al. | 49/395 X |
| 2,197,824 | 4/1940 | Young . | |
| 2,319,982 | 5/1943 | Fralinger | 49/395 X |
| 2,473,065 | 6/1949 | Miller | 49/395 X |
| 2,488,524 | 11/1949 | Castellano . | |
| 4,121,383 | 10/1978 | Holmes et al. | 49/395 |
| 4,523,407 | 6/1985 | Miller | 49/395 X |
| 4,964,755 | 10/1990 | Lewis et al. | 49/465 X |

FOREIGN PATENT DOCUMENTS

| | | | |
|---|---|---|---|
| 802247 | 6/1936 | France | 49/395 |

OTHER PUBLICATIONS

Presray Catalog, "Watertight Doors, Barriers, and Hatches", 3 pages, excerpt Sep. 1991.

*Primary Examiner*—Philip Kannan

*Attorney, Agent, or Firm*—Schweitzer Cornman & Gross

[57] ABSTRACT

An improved locking feature for a watertight hatch incorporates a positive break-open feature to facilitate opening when the hatch is jammed with ice and/or debris. A plurality of radially extending/retracting locking bars cooperate with closing cams such that, when the bars are extended, the hatch is drawn into tight engagement with a sealing gasket. When the locking bars are fully retracted, in order to release the hatch for opening, at least selected ones of the locking bars cooperate with opening cam means whereby full retraction of the bars forcibly displaces the hatch in an opening direction with a high mechanical advantage, initially breaking the hatch free of any restricting ice formation or packed debris. Thereafter, the hatch may be readily opened by being manually lifted in a conventional manner. The arrangement makes it entirely feasible to configure the hatch cover to be flush with its surroundings, so as to be useable in sidewalks, for example, where there may be heavy pedestrian traffic.

10 Claims, 3 Drawing Sheets

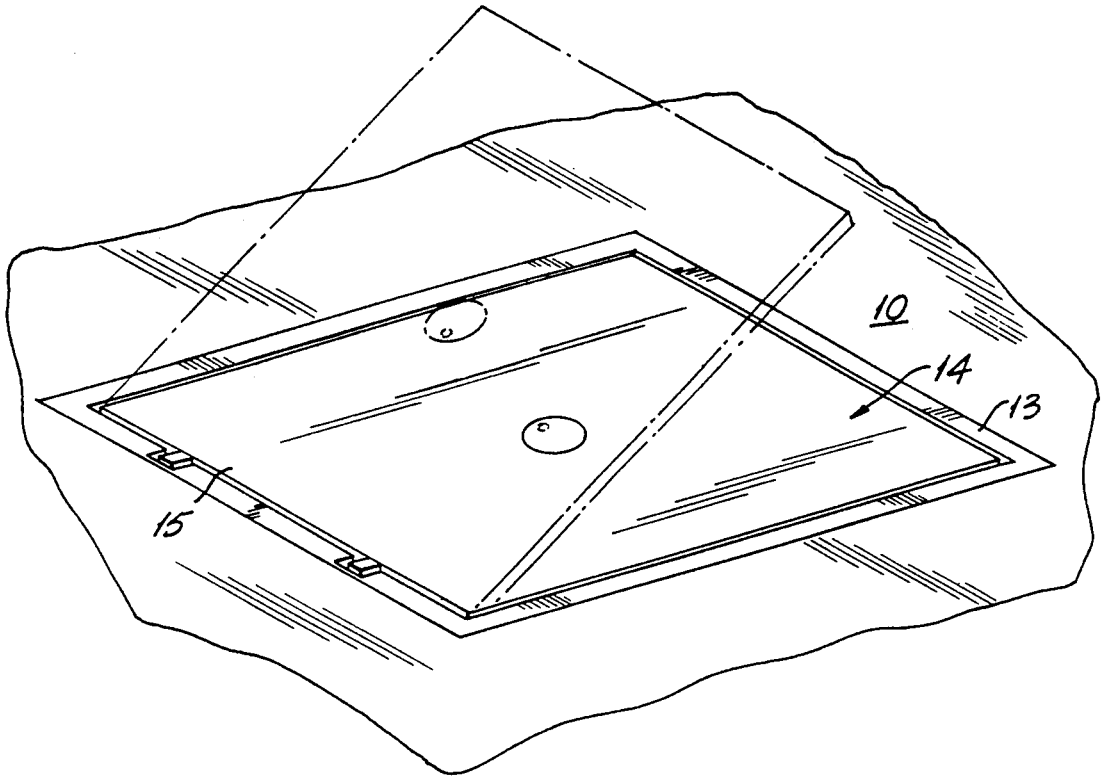
FIG. 1
FIG. 4
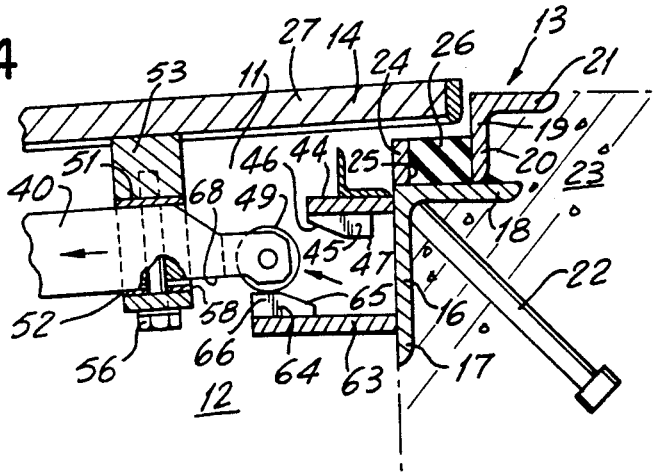

LOCKING/OPENING SYSTEM FOR WATERTIGHT HATCH

BACKGROUND AND SUMMARY OF THE INVENTION

For telephone communications and the like, it is a common practice to utilize controlled environment underground vaults for housing switching gear and other electronic apparatus, terminal junctions, etc. These vaults frequently may be located under sidewalks or the like and typically are provided with a watertight, openable hatch cover, so that workmen may gain access to the interior of the vault when necessary. Because hatch covers of this type are exposed to very severe operating conditions, they must be ruggedly built and must close with a highly effective, watertight seal. The invention is directed to improvements in the design and construction of watertight hatch covers for the purposes described.

An improved form of watertight hatch cover according to the invention incorporates a rugged surrounding metal frame, which can be embedded in a sidewalk or the like and is provided with a recessed sealing gasket. An openable hatch cover is received within the frame, so as to lie flush with the frame and the surrounding grade level, when the hatch is closed. To secure the hatch tightly in a closed position, radially extendable locking bars are provided on the underside of the hatch, and these can be projected radially relative to the frame, into cooperating relation to closing cams provided on the frame. The cooperation between the locking bars and the closing cams serves to draw the hatch cover tightly down against and in sealing contact with the sealing gasket. Typically, externally accessible means are provided for securing the locking bars in their extended positions, so that the vault is accessible only to authorized persons possessing an appropriate opening key.

In an advantageous embodiment of the invention, a hatch cover is hinged at one side to its frame and arranged to be opened and closed by pivoting motion. A rotatable actuating element is provided in the center of the hatch cover, accessible from above by authorized personnel. The actuator is connected to a plurality of radially extending locking bars, slidably mounted on the underneath side of the hatch cover. Rotation of the actuating element in one direction or the other causes radial retraction or extension of the locking bars. In a typical hatch cover arrangement according to the invention, the hatch is of rectangular configuration and the locking bars extend to the corner areas thereof. Cam follower elements, preferably wheels, are provided at the ends of the locking bars. As the bars are extended toward the corners of the hatch, the cam follower elements engage wedge-like closing cams, progressively displacing the hatch cover in a downward direction during the final extension movements of the locking bars. The hatch cover is thus forcibly displaced downward at its four corner areas to effect a tight, uniform, watertight seal between the hatch cover and a sealing gasket provided in the surrounding frame.

In a structure in which the hatch cover is recessed within a surrounding frame, as contemplated herein, water and debris can find its way into the narrow gap between the edges of the hatch cover and the surrounding frame. In winter time, any water present can turn to ice. Thus, the hatch cover commonly can become rather tightly jammed within its surrounding frame and correspondingly difficult to open. As a feature of the invention, at least those locking bars located on the side opposite the hinge are arranged for cooperation with opening cams, provided at the corners of the surrounding frame. When the locking bars are retracted for opening of the hatch cover, the cam followers, in the last stages of opening motion of the locking bars, engage wedge-like opening cams which forcibly displace the locking bars and the hatch cover upwardly. The upward displacement of the hatch cover extends over only a short distance, but is accomplished with a high mechanical advantage. This causes the hatch cover to be broken free of its restricting environment, be it ice or debris. Once the hatch cover has been initially broken free, it can easily be opened in the conventional manner.

For a more complete understanding of the above and other features and advantages of the invention, reference should be made to the following detailed description of a preferred embodiment of the invention and to the accompanying drawings.

DESCRIPTION OF THE DRAWINGS

FIG. 1 is a fragmentary perspective view of a typical installation of watertight hatch cover according to the invention.

FIG. 4 is a fragmentary cross sectional view showing the function of the locking bars in effecting opening displacement of the hatch cover.

DESCRIPTION OF PREFERRED EMBODIMENTS

Figure 2:
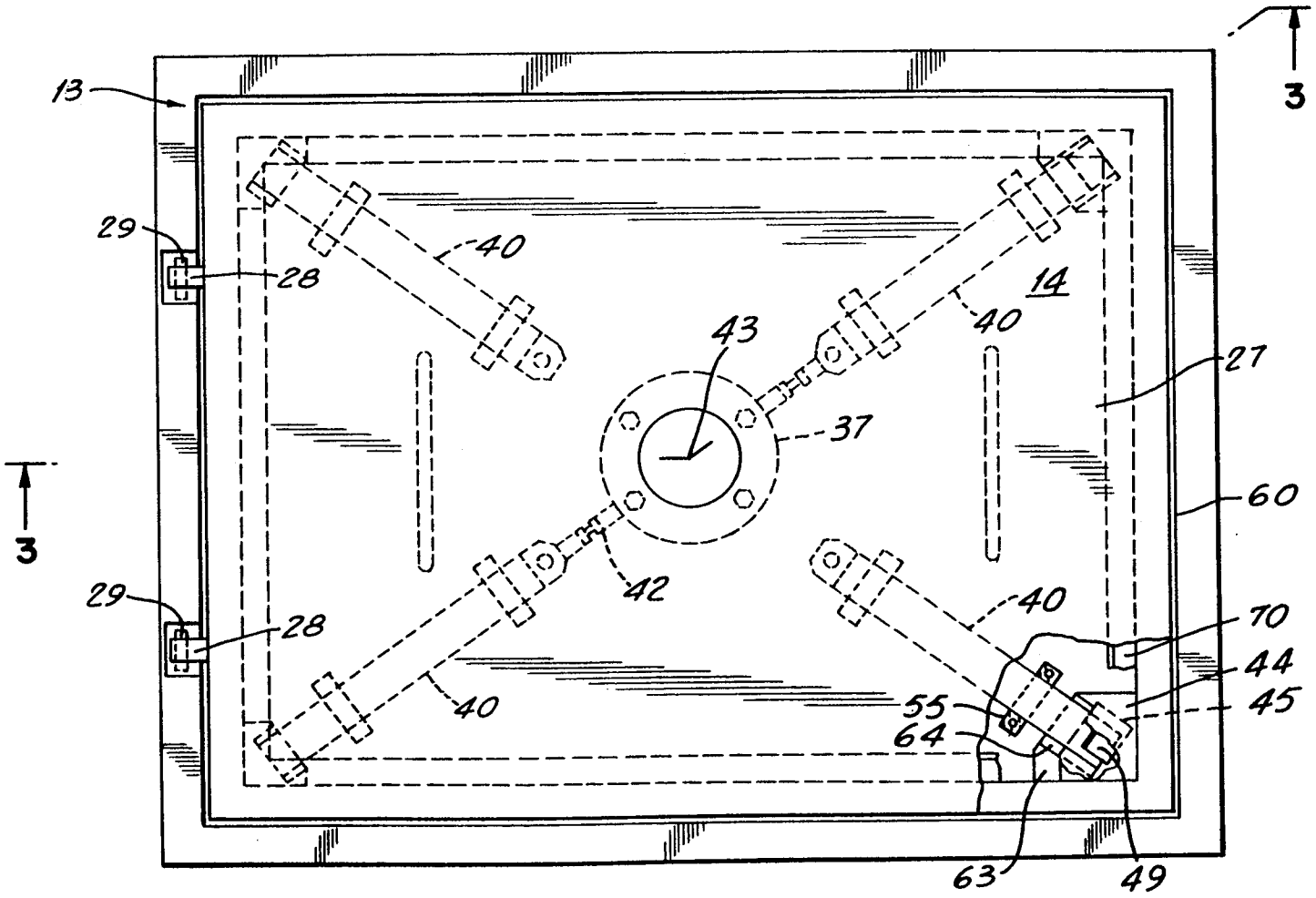
FIG. 2 is a top plan view of the hatch cover device of FIG. 1.

Referring now to the drawing, the reference numeral 10 designates generally an exposed flat surface, which may be formed of concrete or asphalt, for example, and is provided with an opening 11 leading to an underground vault, not specifically illustrated but designated generally by the numeral 12 in FIG. 4. The opening 11 is defined by a frame 13 which, in the illustration, is of rectangular configuration. The frame 13, as will be further described, forms a recessed seat for a rectangular hatch cover 14, which is preferably hinged at one end 15 so as to be able to be pivoted upward, to a position such as shown in broken lines in FIG. 1, to provide access to the subterranean vault.

As shown in FIG. 4, the frame 13 is comprised of a first set of angle members 16, arranged in rectangular configuration and providing a downwardly extending vertical flange 17 and an outwardly projecting horizontal flange 18. Welded or otherwise permanently secured to the horizontal flange portion 18 is a second set of angle members 19, also arranged in rectangular configuration, and providing a downwardly projecting vertical flange 20 and an outwardly extending horizontal flange 21. The structure comprised of the angle members 16, 19 desirably incorporates a plurality of downwardly and outwardly extending anchor elements 22 which serve to permanently secure the frame structure in its surrounding environment of concrete, asphalt or the like, designated by the numeral 23.

Rigidly mounted along the inner extremity of the horizontal flange portions 18, and extending upward therefrom are flange walls 24. The flange walls 24, in conjunction with the horizontal flange portion 18 of the lower angle members 16 and the vertical flange portions 20 of the upper angle members 19, form a continuous upwardly facing channel 25 in which is received a continuous elastomeric sealing element 26.

In the illustrated embodiment of the invention, the hatch cover 14 may be formed of a heavy steel plate 27 provided at one end with hinge lugs 28, which are pivoted in the frame 13 by hinge pins 29. As reflected in FIG. 3, the hinge lugs 28 are provided with vertically elongated openings 30 to receive the hinge pins 29, in order to accommodate limited vertical movement of the hatch cover plate 27 with respect to the surrounding frame 13.

Preferably, the cover plate 27 is provided with an edging strip 31, which is continuous about the entire periphery of the plate and has a portion 32 which projects slightly below the lower surface 33 of the plate for engagement with the continuous elastomeric seal 26, when the hatch cover 14 is in a closed position.

In the center of the cover plate 27 is an opening in which is fixed a cylindrical cup 34 rotatably mounting a generally cylindrical actuator 35. The actuator 35 has a portion 36 projecting through the bottom of the fixed cup 34 and carrying a circular actuator disc 37. The cylindrical actuator 35 is sealed with respect to the fixed cup 34 and is closed at the top by a locked cover plate 38. The locked cover plate 38 is removable only by authorized personnel, to gain access to the rotatable actuator 35. The actuator can be manipulated, by tools normally carried in a telephone maintenance truck, to lock and unlock the hatch cover 14 in relation to its surrounding frame 13.

Figure 3:
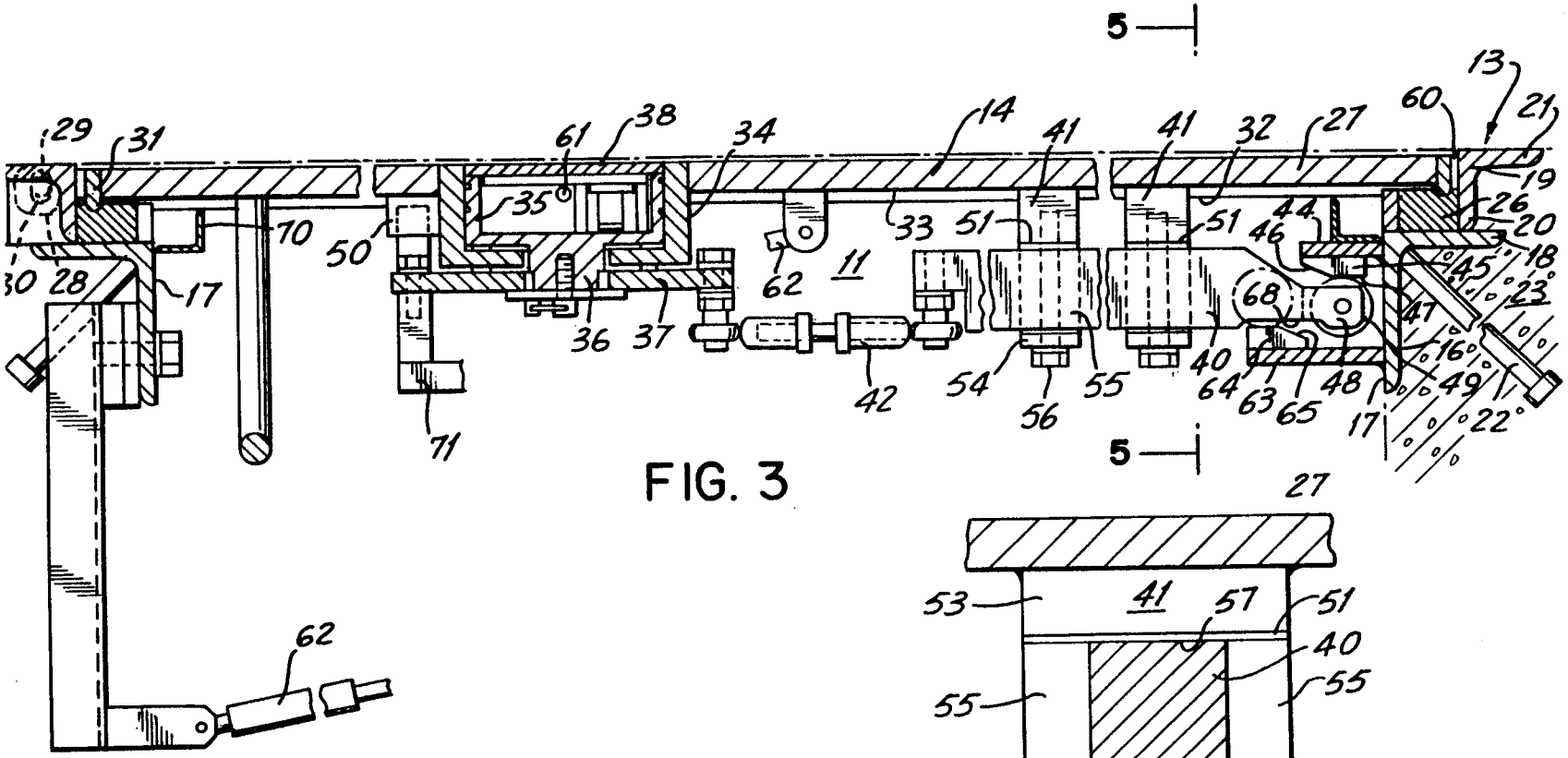
FIG. 3 is an enlarged cross sectional view as taken generally along line 3—3 of FIG. 2.

As shown in FIG. 3, when the hatch cover 14 is in a closed position, but not locked, it is supported by the edge strips 31 resting upon the sealing strip 26. In order to secure the hatch tightly in a closed position, means are provided for mechanically locking the cover in its closed position and also to forcibly displace the plate in a downward direction to ensure a reliable watertight seal between the edge strips 31 and the elastomeric sealing element 26. To this end, the hatch cover assembly is provided on its underneath side with four locking bars 40 which extend generally radially from the circular actuating disc 37 toward the corners of the cover plate 27. As shown in FIG. 3, the locking bars are slidably guided by spaced apart guide brackets 41, which closely surround the locking bars on all four sides, while accommodating radially guided movement toward and away from the corner regions of the cover. Adjustable links 42 connect the locking bars to the actuating disc 37, to accommodate limited radial adjustment of the positioning of the locking bars. The preferred arrangement is such that, when the actuating plate is rotated to a position in which the connecting links 42 are at top dead center, that is radially aligned with the center axis 43 of the actuating disc, each of the locking bars 40 will be in an optimum adjusted position for securing the hatch cover 14 in the manner desired.

At each of the corners of the frame structure 13, there is welded or otherwise rigidly secured a cam support gusset plate 44 carrying on its bottom surface a wedge-like closing cam 45. The closing cam 45 has a downwardly and outwardly inclined cam surface 46 on its inner portion and a generally flat, horizontal locking portion 47 joined therewith and forming the outer portion of the cam. The closing cam 45 is aligned generally along the radial axis of the associated locking bar 40.

Each of the locking bars 40, which are of relatively heavy, rugged construction, is provided with a necked-down outer end portion 48, which is recessed to mount a rotatable cam follower wheel 49. For opening and closing of the hatch cover 14, the several locking bars are retracted to a position in which the cam follower wheels 49 lie inside of the inner edge extremities of the upper cam support gusset plates 44. This is accomplished by rotation of the actuator plate 37 away from the position shown in FIG. 2 to a predetermined rotationally displaced position to achieve the desired degree of retraction. Typically, suitable stop means 50 are provided to limit the rotation of the actuator plate 37 in one direction to the dead center position shown in FIG. 2, and other stop means (not shown) are provided to limit rotation of the actuating plate in the opposite or opening direction.

Assuming the locking bars 40 to be in their respective retracted positions, the cover plate 27 can be lowered to a closing position, somewhat as shown in FIG. 3. Thereafter, the external actuating member 35 is engaged with an appropriate tool and rotated to the locking limit position. During this rotational movement, the respective locking bars 40 are simultaneously moved in an extending direction, eventually causing the cam followers 49 to engage the downwardly inclined surfaces 46 of the closing cams. Continued extending movement of the locking bars 40 thereafter causes the cover plate 27 to be forcibly displaced in a downward direction, as the cam followers 49 continue along the downwardly inclined surfaces 46. When the cam followers reach the horizontal locking surfaces 47 and are moved at least a short distance thereover, the closing and locking action is complete. At this point, the rotary actuating plate 37 should be in its locking limit position, with the connecting links 42 in a dead center position, as shown in FIG. 2.

It will be understood that a locking bar arrangement, details of which are shown in FIG. 3, is provided at each of the four corners of the structure, as is evident in FIG. 2. Accordingly, as the external actuator 35 and the internal actuatinig disc 37 are rotated, all four locking bars are extended simultaneously to effect forcible downward displacement of the cover plate 27 substantially uniformly at its four corners. When the locking bars 40 are fully extended, the continuous edge strip 31 is in tight pressure contact with the sealing strip 26 about the entire periphery of the cover, substantially as shown in FIG. 3, assuring a tight seal all around. It will be noted that the elongated vertical openings 30 in the hinge brackets 28 accommodate the desired amount of forcible downward displacement of the cover plate.

Figure 5:
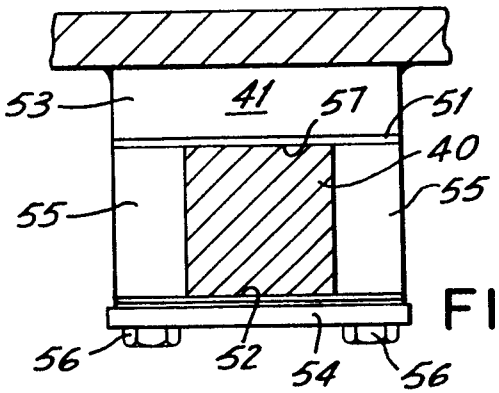
FIG. 5 is an enlarged, fragmentary cross sectional view as taken generally on line 5—5 of FIG. 3.

Individual adjustment of the vertical positioning of the locking bars 40 is provided by an arrangement of bearing plates 51 and shims 52 arranged in the guide brackets 41. Thus, as shown in FIG. 5, the guide brackets are comprised of an upper bar 53, which is welded or otherwise secured to the cover plate 27 and is joined with a cap plate 54, through vertical spacers 55, by means of bolts 56. The bearing plate 51 is interposed between the bar 53 and the vertical spacers 55 and serves as a slide bearing cooperating with the upper surface 57 of the locking bar 40. Shims 52, of which a plurality may be provided, are interposed between the lower ends of the vertical spacers 55 and the cap plate 54. Advantageously, the shims 52 are provided with open-sided, U-shaped recesses 58receiving the shafts of the bolts 56, enabling the shims to be removed and replaced by merely loosening the bolts 56, without requiring their complete removal. During the final installation of the hatch cover and frame assembly, a relatively precise adjustment of the relationship between the locking bars 40 and the closing cams 46 may be effected by the placement of shims above the bearing plate 51, if necessary. Thus, after the final assembly and adjustment, it is assured that the downward displacement of the cover plate upon extension of the locking bars will be substantially uniform at each of the corners of the structure.

As shown particularly in FIG. 3, a small clearance gap exists about the entire periphery of the hatch cover, between the continuous edge strip 31 and the surrounding upper angle member 19. Where the hatch cover system is exposed to the elements, as is typically expected, this clearance space forms an upwardly opening receptacle which, over time, can become filled with water and debris. In cold weather, the water may turn to ice. Thus, it is common for the hatch cover to become tightly jammed in its frame, making it difficult to open the hatch cover from the exterior. In the absence of foreign material in the clearance slot, the hatch cover normally can be easily lifted by engaging the cover by means of a handle 61 provided on the rotary actuator 35 and accessible after removal of the locked cover plate 38. Desirably, the cover is also provided with means such as a gas spring device 62 to assist in counterbalancing the weight of the cover, so as to be relatively easily liftable, in the absence of obstruction.

In accordance with the invention, a novel and simplified arrangement is provided for forcibly upwardly displacing the cover plate 27, at least at the end thereof remote from the hinge lugs 28. To this end, the corners of the frame structure 13 opposite from the hinge lugs are provided with lower cam support gusset plates 63, similar to the upper gusset plates 44 but somewhat larger to project beyond the inward extremities of the gusset plates 44. Each of the plates 63 mounts an upwardly facing wedge-like opening cam 64 which includes an upwardly inclined cam surface 65. In the illustrated structure, the locking bars are notched out at 68 to provide clearance above the opening cams 64, when the locking bars are fully extended.

When the actuator plate 37 is rotated to simultaneously retract all of the locking bars 40, the cam follower wheel moves off of the flat surface 47 of the closing cam. Shortly thereafter, with continued retracting movement of the locking bars, the cam followers engages the upwardly inclined surfaces 65 of the opening cams. Continued retraction of the locking bars displaces upwardly both the cam follower wheels 49 and the locking bars on which they are supported. This in turn forcibly displaces the cover plate 27 in an upward direction with a high mechanical advantage provided by the inclined surface 65.

In a typical and advantageous embodiment of the invention, wherein the cover plate 27 may have typical dimensions of about three feet by about four feet, the relationship of the opening and closing cams 45, 64 and the cam follower wheels 49 are such that, upon full retraction of the locking bars 40, a forcible upward displacement of the cover plate of about one quarter inch is effected. The upwardly displaced condition of the cover plate is illustrated in FIG. 4, which shows a locking bar 40 fully retracted, with the cam follower wheel 49 resting on an upwardly facing horizontal surface portion 66 of the opening cam 64. Once the cover plate 27 is forcibly broken free, as shown in FIG. 4, the cover can easily be lifted, if not by the action of the gas spring 62 alone, then with its assistance.

Desirably, an angle member 70 is welded to the vertical flange 17 of the lower frame angle 16, about its entire internal exposure, and forms a catch trough for receiving spillage of water or debris, when the hatch cover is opened.

Typically and desirably, a handle 71, partially shown in FIG. 3, is secured to the actuator disc 37, to enable rotation of that disc from within the vault.

The structure of the invention provides a rugged, reliable and yet relatively simplified mechanism for closure and locking of a watertight hatch closure which at the same time provides for forcible, high leverage upward displacement of the hatch cover when the locking mechanism is released. This enables a watertight hatch cover, which is recessed within a surrounding frame, to be broken free of any accumulated debris or ice, for example. Once freed through a short distance, forcible upward displacement, the hatch cover is easily opened the rest of the way, because little or no further resistance, beyond the dead weight of the hatch cover assembly, is encountered.

The arrangement of the invention makes it entirely feasible to provide for mounting of the watertight hatch cover in flush relation to its surrounding frame and to the surrounding environment, so that the closure may be located without difficulty in areas of high pedestrian traffic, for example. The arrangement of locking bars and cam blocks is such that, when the hatch cover is locked by rotary movement of the actuating cup 35, the cam followers 49 are forcibly displaced downward by the inclined surfaces of the closing cams 45, so that the edging strip 31 surrounding the cover plate 27 is tightly compressed into the elastomeric seal 26. This also assures a tight seal of the elastomeric element 26 with its lateral confinement.

Although the flush arrangement of the hatch cover necessitates the provision of a peripheral clearance space 60, which may become filled with water and/or debris, the incorporation into the locking mechanism of a set of opening cams, for forcible, high mechanical advantage upward displacement of the hatch cover upon retraction of the locking bars provides for reliable and relatively easy opening of the hatch cover, using conventional tools normally carried in a telephone maintenance truck, for example.

The structure of the invention is mechanically simplified, yet durable and functional. Its utilization greatly facilitates the convenient use of exposed environmental faults of the type contemplated.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. In a watertight hatch assembly of the type comprising (a) a frame defining an opening of predetermined size and shape, (b) a hatch cover mounted in said frame for opening and closing movements with respect thereto, (c) a continuous resilient sealing member supported by one of said frame or said hatch cover within said opening and having a contact surface facing the other of said frame or hatch cover and engageable therewith when said hatch cover is in a closed position with respect to said frame, (d) said resilient sealing member forming a continuous peripheral seal between said hatch cover and said frame when said hatch cover is in a closed position, and (e) locking means for securing said hatch cover in closed position with respect to said frame with said sealing member under sealing compression therebetween, the improvement characterized by (f) said locking means comprising a plurality of locking bars slidably mounted on inside surface areas of said hatch cover for movement toward and away from said frame, (g) actuator means engageable from an external side of said hatch cover for extending said locking bars toward said frame and into a locked relation therewith and retracting said locking bars away from said frame and into an unlocked relation therewith, (h) at least certain of said locking bars having outer end portions engageable with portions of said frame, when said locking bars are actuated to extended positions, to displace said hatch cover in a closing direction with respect to said frame and thereby to compress said continuous peripheral seal, (i) at least certain of said locking bars having outer end portions engageable with portions of said frame when said locking bars are actuated to retracted positions, away from said frame and into an unlocked relation therewith, to forcibly displace said hatch cover in an opening direction with respect to said frame, to free said hatch cover for opening.

2. A hatch assembly according to claim 1, further characterized by (a) said locking bars being rigidly guided on said hatch cover, each being mounted for movement on an axis fixed in relation to said hatch cover, (b) a cam follower element mounted at an outer end of each of said locking bars, (c) closing cam elements rigidly mounted on said frame and positioned to be engaged by the follower elements of at least certain of said locking bars when said bars are actuated in an extending direction toward said frame and to forcibly displace said follower elements in a hatch-closing direction, (d) said cam follower elements, when said locking bars are actuated to retracted positions, being spaced inwardly of said closing cam elements to accommodate opening of said hatch cover, (e) opening cam elements rigidly mounted on said frame and positioned to be engaged by follower elements of at least certain of said locking bars, when said bars are actuated toward retracted positions, to forcibly displace said hatch cover in an opening direction with respect to said frame.

3. A hatch assembly according to claim 2, further characterized by (a) upper cam supporting gusset plates rigidly secured to corners of said frame and mounting said closing cam elements to face downwardly therefrom, (b) lower cam supporting gusset plates rigidly secured to at least selected corners of said frame and mounting said opening cam elements to face upwardly therefrom, (c) said outer end portions of selected ones of said locking bars, corresponding to said selected corners, being supported by said opening cam elements when said selected locking bars are in retracted positions, (d) said opening cam elements being offset from an associated closing cam element whereby, upon retraction of said selected locking bars, the outer end portions thereof sequentially disengage from associated closing cam elements and engage associated opening cam elements, (e) said opening cam elements being operative to forcibly upwardly displace said selected locking bars to effect an initial break open of said hatch cover.

4. A hatch assembly according to claim 2, further characterized by (a) upper cam supporting gusset plates mounted at corners of said frame and carrying said closing cam elements.

5. A hatch assembly according to claim 4, further characterized by (a) lower cam supporting gusset plates mounted at selected corners of said frame and carrying said opening cams, (b) said outer portions of said locking bars being aligned at a level between said upper and lower gusset plates.

6. A hatch assembly according to claim 5, further characterized by (a) hinge means connecting one side of said hatch cover to one side of said frame to accommodate pivoting opening and closing movements of said hatch cover, and (b) said lower gusset plates being located at corners of said frame remote from said hinge means.

7. A hatch assembly according to claim 1, further characterized by (a) said frame defining an upwardly opening channel, (b) said resilient sealing member being received in said channel and having an exposed upper surface, (c) said hatch cover having a continuous peripheral edge projecting downward therefrom and aligned with said sealing member, (d) said peripheral edge being displaced toward and into tight sealing contact with said sealing member upon full extension of said locking bars.

8. A hatch assembly according to claim 1, further characterized by (a) mounting brackets carried by said hatch cover and slidably receiving said locking bars for extending and retracting movements, (b) each of said mounting brackets including a cross bar member positioned above the locking bar, a pair of vertical spacer bars straddling said locking bar and laterally guiding said locking bar, a cap plate extending underneath the locking bar, and bolts securing said cap plate and said vertical spacer bars to said cross bar, and (c) shims slectively insertable between said cross bar and said vertical spacer bars to adjust the vertical position of a locking bar with respect to said hatch cover.

9. A hatch assembly according to claim 8, further characterized by (a) said shims having open sided recesses therein for the reception of said bolts, to enable insertion and removal of said shims without removal of said bolts.

10. A hatch assembly according to claim 1, further characterized by (a) said frame being placed in substantially flush relation to a surrounding surface area, (b) said hatch cover being recessed within said frame and having an upper surface substantially flush with said surrounding surface area, (c) adjacent internal vertical surfaces of said frame and external edge surfaces of said hatch cover forming, with said resilient sealing member, an upwardly opening exposed peripheral space.

* * * * *